US009096918B2

(12) United States Patent
Taniguchi et al.

(10) Patent No.: US 9,096,918 B2
(45) Date of Patent: Aug. 4, 2015

(54) FACILITY FOR PRODUCTION OF HIGH STRENGTH STEEL SHEET OR HOT DIP ZINC COATED HIGH STRENGTH STEEL SHEET EXCELLENT IN ELONGATION AND HOLE EXPANDABILITY

(75) Inventors: Hirokazu Taniguchi, Futtsu (JP); Toshiki Nonaka, Tokai (JP); Hiroki Murayama, Tokai (JP); Koji Yanaba, Tokai (JP); Satoshi Kato, Tokai (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1676 days.

(21) Appl. No.: 11/719,718

(22) PCT Filed: Nov. 9, 2005

(86) PCT No.: PCT/JP2005/020977

§ 371 (c)(1),
(2), (4) Date: Mar. 11, 2009

(87) PCT Pub. No.: WO2006/054564

PCT Pub. Date: May 26, 2006

(65) Prior Publication Data

US 2009/0205755 A1 Aug. 20, 2009

(30) Foreign Application Priority Data

Nov. 19, 2004 (JP) ..... 2004-335598

(51) Int. Cl.
*C21D 9/50* (2006.01)
*C22C 38/04* (2006.01)
(Continued)

(52) U.S. Cl.
CPC . *C22C 38/04* (2013.01); *C21D 1/25* (2013.01); *C21D 9/52* (2013.01); *C21D 9/573* (2013.01);
(Continued)

(58) Field of Classification Search
CPC ..... C21D 1/25; C21D 9/52; C21D 9/573; C22C 38/00; C22C 2/02; C22C 2/06; C22C 2/26; C22C 2/28; C22C 2/40
USPC ..... 266/249, 259; 148/529
See application file for complete search history.

(56) References Cited

U.S. PATENT DOCUMENTS

| | | | | |
|---|---|---|---|---|
| 4,759,807 | A * | 7/1988 | Sippola | 148/533 |
| 5,284,680 | A | 2/1994 | Bilimoria | |
| 2005/0084702 | A1 * | 4/2005 | Olashuk | 428/588 |

FOREIGN PATENT DOCUMENTS

| | | | |
|---|---|---|---|
| CA | 1321127 | | 8/1993 |
| CA | 2559587 | A1 * | 9/2005 |

(Continued)

OTHER PUBLICATIONS

Tsurumaru, H., English machine translation of JP 2002-294351, Oct. 2002, whole document.*

(Continued)

*Primary Examiner* — Scott Kastler
(74) *Attorney, Agent, or Firm* — Birch, Stewart, Kolasch & Birch, LLP

(57) ABSTRACT

Exemplary embodiments of a facility or an arrangement capable of producing a high strength steel sheet or a hot dip zinc coated high strength steel sheet according to the present invention are provided which can make a quenching facility and tempering facility continuous treatment facilities. For example, an improvement in the material quality can be effectuated due to tempering enable improvement of the hole expandability. In addition, an elongation of the sheet can be improved. For example, an exemplary production facility/arrangement for high strength steel sheet or hot dip zinc coated high strength steel sheet excellent in elongation and hole expandability can be provided by arranging in a continuous annealing facility or a continuous hot dip zinc coating facility or their joint facility or continuously with the same, (i) a quenching facility able to cool steel sheet after recrystallization or after recrystallization and after hot dip zinc coating down to a temperature region of the martensite transformation point or less, (ii) a tempering facility for tempering the steel sheet and holding its temperature, and (iii) a recooling facility for cooling the steel sheet to about 100° C. or less.

4 Claims, 4 Drawing Sheets

(51) Int. Cl.

| | |
|---|---|
| ***C21D 9/52*** | (2006.01) |
| ***C22C 38/02*** | (2006.01) |
| ***C22C 38/06*** | (2006.01) |
| ***C22C 38/12*** | (2006.01) |
| ***C23C 2/02*** | (2006.01) |
| ***C23C 2/26*** | (2006.01) |
| ***C23C 2/28*** | (2006.01) |
| ***C21D 9/573*** | (2006.01) |
| ***C21D 1/25*** | (2006.01) |

(52) U.S. Cl.
CPC ..... *C22C 38/02* (2013.01); *C22C 38/06* (2013.01); *C22C 38/12* (2013.01); *C23C 2/02* (2013.01); *C23C 2/26* (2013.01); *C23C 2/28* (2013.01)

(56) References Cited

FOREIGN PATENT DOCUMENTS

| | | |
|---|---|---|
| DE | 10238972 | 3/2004 |
| JP | 57094528 | 6/1982 |
| JP | 6111299 | 4/1986 |
| JP | 01229877 | 9/1989 |
| JP | 2821481 | 9/1998 |
| JP | 2002275546 | 9/2002 |
| JP | 2002294351 | 10/2002 |
| JP | 2004256872 | 9/2004 |

OTHER PUBLICATIONS

Wisti et al., "Tempering of Steel-Induction Tempering", ASM Handbook, 1991, ASM International, vol. 4, p. 1-3.*

Davis, Joseph R., "Hot-Dip Galvanized Coatings", Metals Handbook Desk Edition, 1198, ASM International, p. 1-5.*

Office Action of associated Canadian Patent Application No. 2,587,953, Jan. 2009.

European Search Report for European Patent Application No. 05806771.1 mailed on Apr. 19, 2013.

* cited by examiner

FINAL HOLE EXPANSION VALUE λ:45% LEVEL

FINAL HOLE EXPANSION VALUE λ:55% LEVEL

FINAL HOLE EXPANSION VALUE λ:65% LEVEL

FACILITY FOR PRODUCTION OF HIGH STRENGTH STEEL SHEET OR HOT DIP ZINC COATED HIGH STRENGTH STEEL SHEET EXCELLENT IN ELONGATION AND HOLE EXPANDABILITY

CROSS REFERENCE TO RELATED APPLICATION(S)

The present application is a national phase application of International Application PCT/JP2005/020977 filed on Nov. 9, 2005 and published as International Publication WO 2006/054564 on May 26, 2006. This application claims priority from the International Application pursuant to 35 U.S.C. §365. The present application also claims priority from Japanese Patent Application No. 2004-335598 filed on Nov. 19, 2004 under 35 U.S.C. §119. The disclosures of these applications are incorporated herein in their entireties.

FIELD OF THE INVENTION

The present invention relates to a facility for production of high strength steel sheet or hot dip zinc coated high strength steel sheet excellent in elongation and hole expandability.

BACKGROUND INFORMATION

Recently, improvement of the fuel economy of motor vehicles and reduction of the weight of vehicle chasses have been deemed important. To reduce the weight, the usage of high strength steel sheet has been increasing. However, the higher the strength, the more difficult the formability can become. In particular, the steel material can fall in elongation. Further, depending on the member to be produced, there may be a few parts where burring is performed to expand a machined hole to form a flange. A demand has also risen for a hole expandability as possibly an important characteristic.

Therefore, to address such demand, Japanese Patent Publication (A) No. 2001-192768, Japanese Patent Publication (A) No. 2001-200338, Japanese Patent Publication (A) No. 2001-3150, Japanese Patent Publication (A) No. 2001-207235, Japanese Patent Publication (A) No. 2001-207236, Japanese Patent Publication (A) No. 2002-38248, Japanese Patent Publication (A) No. 2002-309334, and Japanese Patent Publication (A) No. 2002-302734 have been provided which describe an improvement in the hole expandability in TRIP steel or composite structure steel sheet via a technique for using tempered martensite and conducting annealing heat treatment twice.

In this way, a high strength steel sheet for which hole expandability is preferred may be increasingly provided hot dip zinc coatings. On the other hand, there may also be a demand for high hole expandability high strength steel sheet without hot dip zinc coatings. In addition, relatively soft steel sheet previously used for exterior panels of motor vehicles and steel sheet with extremely large deep drawability used for oil pans, etc. may be regularly produced.

To produce such diverse types of steel sheet stably and efficiently, with a conventional single-objective type of continuous annealing facility continuously annealing steel sheet or a continuous annealing hot dip zinc coating facility able to continuously treat steel from annealing to hot dip zinc coating by a series of facilities, a plurality of such facilities can be combined and passed through. This may provide a problem of additional construction of facilities, lengthening of the production time, and increase in the production costs.

SUMMARY OF EXEMPLARY EMBODIMENTS OF THE INVENTION

Exemplary embodiments of the present invention facilitate an efficiently production, both cost- and time-wise, of high strength steel sheet or hot dip zinc coated high strength steel sheet excellent in elongation and hole expandability which can be used, e.g., auto parts, etc.

Facilities for the production of high strength steel sheet or hot dip zinc coated high strength steel sheet excellent in elongation and hole expandability have been reviewed. As a result, it was determined that by arranging in a continuous annealing facility or hot dip zinc coating facility or their joint facility or continuously with the same a quenching facility, it is possible to cool annealed steel sheet down to a temperature region of the martensite transformation point or less and a tempering facility for tempering the steel sheet, and maintaining it in temperature which enables the amount of tempered martensite to be freely controlled. This can be important in securing and improving the elongation and hole expandability. For example, according to the exemplary embodiments of the present invention, in contrast which the case where the quenching facility and the tempering facility are in separate production lines and a sheet is cooled down to ordinary temperature once between the quenching and tempering, by providing a series of continuous treatment facilities, it may be possible to freely control the quenching/tempering temperature and possible to freely control the amount of tempered martensite. This can play a large role in the securing and improvement of the elongation and hole expansion rate, and the tensile strength.

Thus, according to the exemplary embodiments of the present invention, a production facility can be provided for high strength steel sheet or hot dip zinc coated high strength steel sheet excellent in elongation and hole expandability. Using such exemplary facility, it may be possible to arrange a tempering facility for tempering the steel sheet and holding its temperature, and a recooling facility for cooling the steel sheet to 100° C. or less. Such exemplary arrangement can be provided in a continuous annealing facility or a continuous hot dip zinc coating facility or their joint facility or continuously with the same a quenching facility able to cool steel sheet after recrystallization or after recrystallization and after hot dip zinc coating down to a temperature region of the martensite transformation point or less.

According to another exemplary embodiment of the present invention, a tempering temperature rise ΔT between the quenching facility and the tempering facility can fall in a range of the following exemplary relationship (A) obtained from the post-tempering tensile strength TS and hole expansion rate λ and in that a pre-tempering temperature T (° C.) falls in a range of the following exemplary relationship (B) found from the post-tempering tensile strength TS and hole expansion rate λ.

$$0.028(\lambda-28)TS-11.5\lambda-40 \leq \Delta T \leq 0.028(\lambda-28)TS-7.5\lambda-90 \quad (A)$$

$$[\{-2(\lambda-40)^2\}/10^5]\times(TS-580)^2-8\lambda+700 \leq T \leq [\{-15(\lambda-45)\}/10^5]\times(TS-580)^2-\lambda+555 \quad (B)$$

where, λ: hole expansion rate (%)

TS: post-tempering tensile strength (MPa)

T: pre-tempering temperature T(° C.)

ΔT: tempering temperature rise (° C.)

Further, the quenching facility can include a cooling system of atomized water cooling, mist cooling, water spray cooling, and/or deep water cooling. The tempering facility can have a heating system of induction heating.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figure showing illustrative embodiment(s), result(s) and/or feature(s) of the exemplary embodiment(s) of the present invention, in which.

DETAILED DESCRIPTION OF EXEMPLARY EMBODIMENTS OF INVENTION

Described below is an exemplary embodiment a facility for the production of high strength steel sheet or hot dip zinc coated high strength steel sheet excellent in elongation and hole expandability according to the present invention according to the present invention with reference to examples.

EXAMPLES

Figure 1:
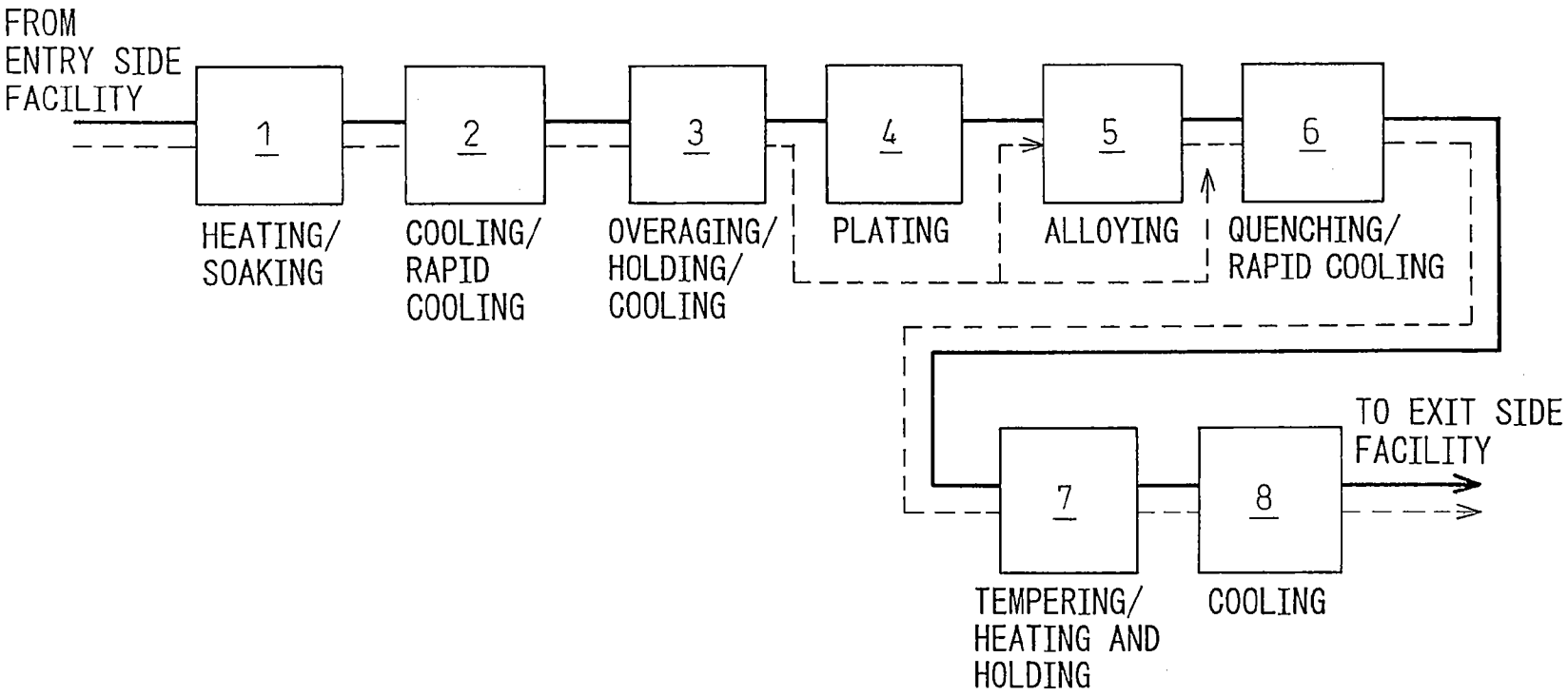
FIG. 1 is an explanatory block diagram of a facility for production of high strength steel sheet or hot dip zinc coated high strength steel sheet excellent in elongation and hole expandability according to an exemplary embodiment of the present invention.

FIG. 1 shows a block diagram showing an exemplary embodiment of a joint production facility for annealing of cold rolled steel sheet or hot rolled steel sheet and production of hot dip zinc coated steel sheet as an example. This exemplary embodiment can be constituted by a facility for production of high strength steel sheet or hot dip zinc coated high strength steel sheet excellent in elongation and hole expandability.

The facility for production of a high strength steel sheet or hot dip zinc coating according to the exemplary embodiment of the present invention, as shown in FIG. 1, can comprise an annealing and heating facility 1, annealing and cooling facility 2, holding facility 3, hot dip zinc coating facility 4, alloying facility 5, quenching facility 6, tempering facility 7, and recooling facility 8 successively arranged. As provided in FIG. 1, a solid arrow shows the pass line at the time of production of a hot dip zinc coated steel sheet, the broken arrow shows the pass line at the time of annealing the cold rolled steel sheet or hot rolled steel sheet, that is, a pass line bypassing the hot dip zinc coating facility and returning to the original pass line before the alloying facility or quenching facility.

Example 1

Exemplary Production of Hot-Rolled or Cold-Rolled High Strength Steel Sheet

It is possible to produce hot rolled or cold rolled steel sheet, in particular high strength steel sheet excellent in elongation and hole expandability, for example, hot rolled or cold rolled steel sheet containing by wt % C: 0.01 to 0.3%, Si: 0.005 to 2%, Mn: 0.1 to 3.3%, P: 0.001 to 0.06%, S: 0.001 to 0.01%, Al: 0.01 to 1.8%, and N: 0.0005 to 0.01% and having the balance of Fe and unavoidable impurities is heated by an annealing and heating facility 1 to $Ac_1$ to $Ac_3$+100° C. in temperature over 30 seconds to 30 minutes, then cooled by an annealing and cooling facility 2 by 1° C./sec or more of a cooling rate to 450 to 600° C. in temperature. Further, it is possible to hold such sheet via a holding facility 3 at 150 to 500° C. in temperature for 10 seconds to 30 minutes, then, in the case of the "no-plating pass" of FIG. 1, route a is proceeded through so as to bypass the hot dip zinc coating facility 4. Then, as shown by the route b, the alloying facility 5 can be passed there through. Further, it is also possible to bypass even the alloying facility as shown by route c. Next, such sheet can be cooled by the quenching facility 6 by 1° C./sec or more of a cooling rate down to a temperature region of the martensite transformation point or less, may be held by the tempering facility 7 at 200° C. to 500° C. in temperature for 1 second to 5 minutes, and can be cooled by the recooling facility 8 by 5° C./sec or more of a cooling rate down to 100° C. or less. Further, the above ranges of ingredients, temperature conditions, etc. are preferable ranges. The exemplary embodiments of the present invention are not limited to such ranges.

Example 2

Production of Hot Dip Zinc Coated High Strength Steel Sheet/Quenching and Tempering after Hot Dip Zinc Coating When producing an exemplary embodiment of a hot rolled or cold rolled hot dip zinc coated high strength steel sheet, in particular, the hot dip zinc coated high strength steel sheet excellent in elongation and hole expandability, for example, a plating sheet containing by wt % C: 0.01 to 0.3%, Si: 0.005 to 2%, Mn: 0.1 to 3.3%, P: 0.001 to 0.06%, S: 0.001 to 0.01%, Al: 0.01 to 1.8%, and N: 0.0005 to 0.01% and having the balance of Fe and unavoidable impurities, such steel sheet can be heated by the annealing and heating facility 1 to the $Ac_1$ to $Ac_3$+100° C. in temperature over 30 seconds to 30 minutes, then cooled by the annealing and cooling facility 2 by 1° C./sec or more of a cooling rate down to 450 to 600° C. in temperature. Next, it is possible to maintain such sheet by the holding facility 3 at 150 to 500° C. in temperature for 10 seconds to 30 minutes, then passed the sheet along the "plating pass" of FIG. 1 through a hot dip zinc coating facility 4 to give it a predetermined deposited weight of hot dip zinc coating. Further, it is possible to have the sheet alloyed by the alloying facility 5. In addition, the sheet can be cooled by the quenching facility 6 by 1° C./sec or more of a cooling rate down to a temperature region of the martensite transformation point or less, then raised by the tempering facility 7 to 200° C. to 500° C. in temperature and held there for 1 second to 5 minutes, then cooled by a recooling facility 8 by 5° C./sec or more of a cooling rate down to 100° C. or less. Further, the ranges of ingredients, temperature conditions, etc. are exemplary ranges. The exemplary embodiments of the present invention are not limited to such ranges Example 3

Production of Hot Dip Zinc Coated High Strength Steel Sheet/Quenching and Tempering Before Hot Dip Zinc Coating When producing the exemplary embodiment of the hot rolled or cold rolled hot dip zinc coated high strength steel sheet, in particular hot dip zinc coated high strength steel sheet excellent in elongation and hole expandability, for example a plating sheet containing by wt % C: 0.01 to 0.3%, Si: 0.005 to 2%, Mn: 0.1 to 3.3%, P: 0.001 to 0.06%, S: 0.001 to 0.01%, Al: 0.01 to 1.8%, and N: 0.0005 to 0.01% and having the balance of Fe and unavoidable impurities, it is possible to heat such sheet by the annealing and heating facility 1 to the $Ac_1$ to $Ac_3$+100° C. in temperature over 30 seconds to 30 minutes, then cooled it by the annealing and cooling facility 2 used as a quenching facility in the same or approximately the same way as the quenching facility 6 of Example 2 by 1° C./sec or more of a cooling rate down to the temperature region of the martensite transformation point or less. The sheet can be raised by the holding facility 3 used as a tempering facility in the same or approximately the same way as the tempering facility 7 of Example 2 to 200° C. to 500° C. in temperature, and the sheet can be maintained there for 1 second to 5 minutes.

Further, the steel sheet can be passed along the "plating pass" of FIG. 1 through the hot dip zinc coating facility 4 to give it a predetermined deposited weight of hot dip zinc coating and, in accordance with need, is alloyed by the alloying facility 5. Next, the sheet can be cooled by the quenching facility 6 or recooling facility 8 by 5° C./sec or more of a cooling rate down to 100° C. or less. When the sheet is cooled by the quenching facility 6 by a 5° C./sec or more cooling rate down to 100° C. or less, the tempering facility 7 can pass the sheet through without heating. When the steel sheet is cooled by the recooling facility 8 by 5° C./sec or more of cooling rate down to 100° C. or less, the quenching facility 6 and tempering facility 7 can pass the sheet through without cooling or heating or else cooling or heating may not be positively applied and the sheet is kept to the extent of holding its temperature. In this exemplary manner, the facilities can be suitably selectively used in accordance with the introduction of the hot dip zinc coated layer. Further, the range of ingredients, temperature conditions, etc. are exemplary ranges. The exemplary embodiments of the present invention are not limited to such ranges.

As described above with reference to Examples 1-3, the quenching/tempering facility can be arranged inside the continuous annealing facility or continuous hot dip zinc coating facility or their joint facility or continuously with the same. Further, as an exemplary arrangement, in the case of a continuous annealing facility, the quenching/tempering facility can be arranged at the exit side of the annealing and cooling facility 2 or the exit side of the holding facility 3, while in the case of a continuous hot dip zinc coating facility, the quenching/tempering facility may be arranged continuously with the hot dip zinc coating facility 4 or alloying treatment facility 5. In the case of a joint facility of a continuous annealing facility and continuous hot dip zinc coating facility, it is possible to employ an arrangement of the quenching/tempering facility alone or in combination. In the case of a double use facility, arranging a quenching/tempering facility as shown in FIG. 1 may be used in that it enables selection of the quenching/tempering and separate production before and after plating with or without plating, so the facility cost may be low.

Figure 2:
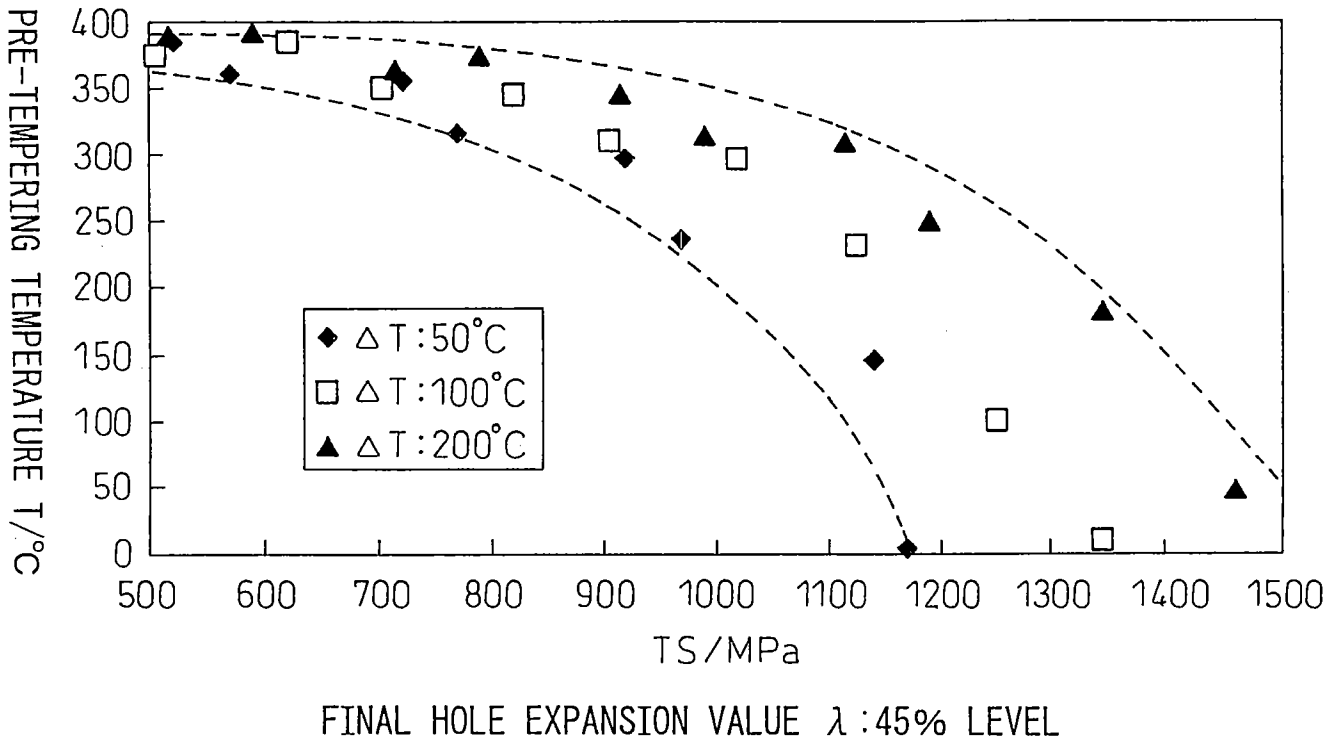
FIG. 2 is an exemplary graph of a relationship between a pre-tempering temperature and TS at the 45% level of a final hole expansion value.
Figure 3:
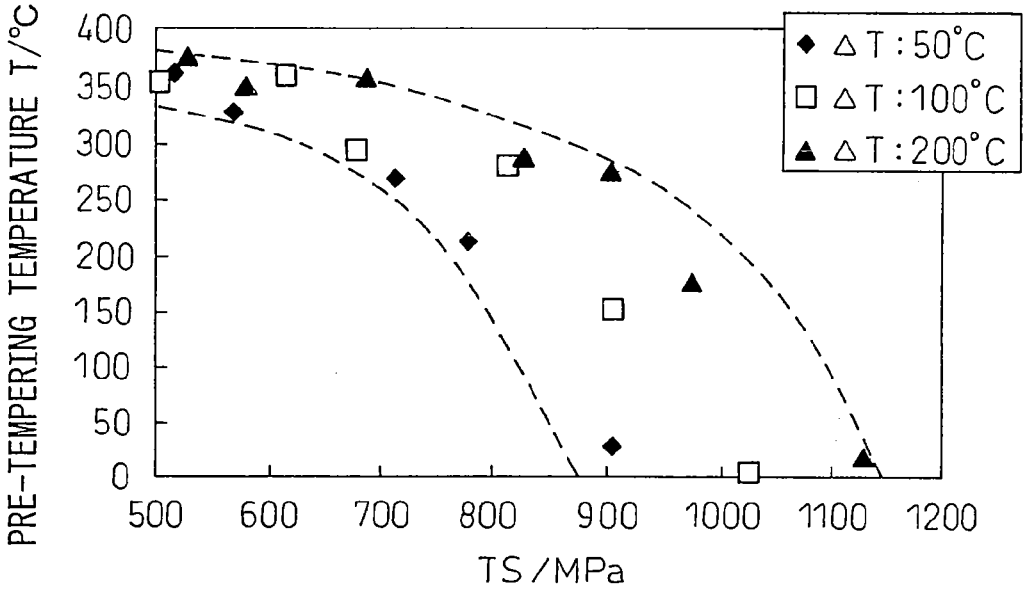
FIG. 3 is an exemplary graph of a relationship between the pre-tempering temperature and TS at the 55% level of the final hole expansion value.
Figure 4:
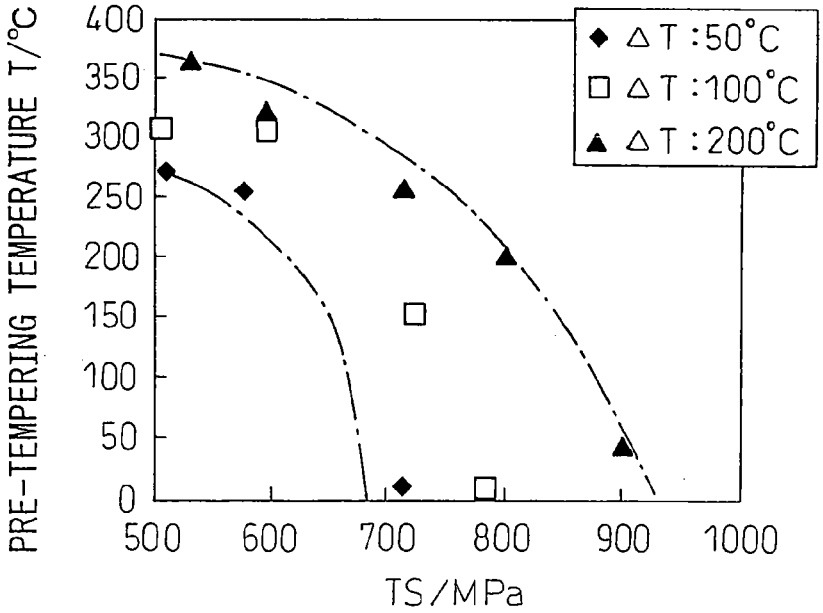
FIG. 4 is an exemplary graph of a relationship between the pre-tempering temperature and TS at the 65% level of the final hole expansion value.
Figure 5:
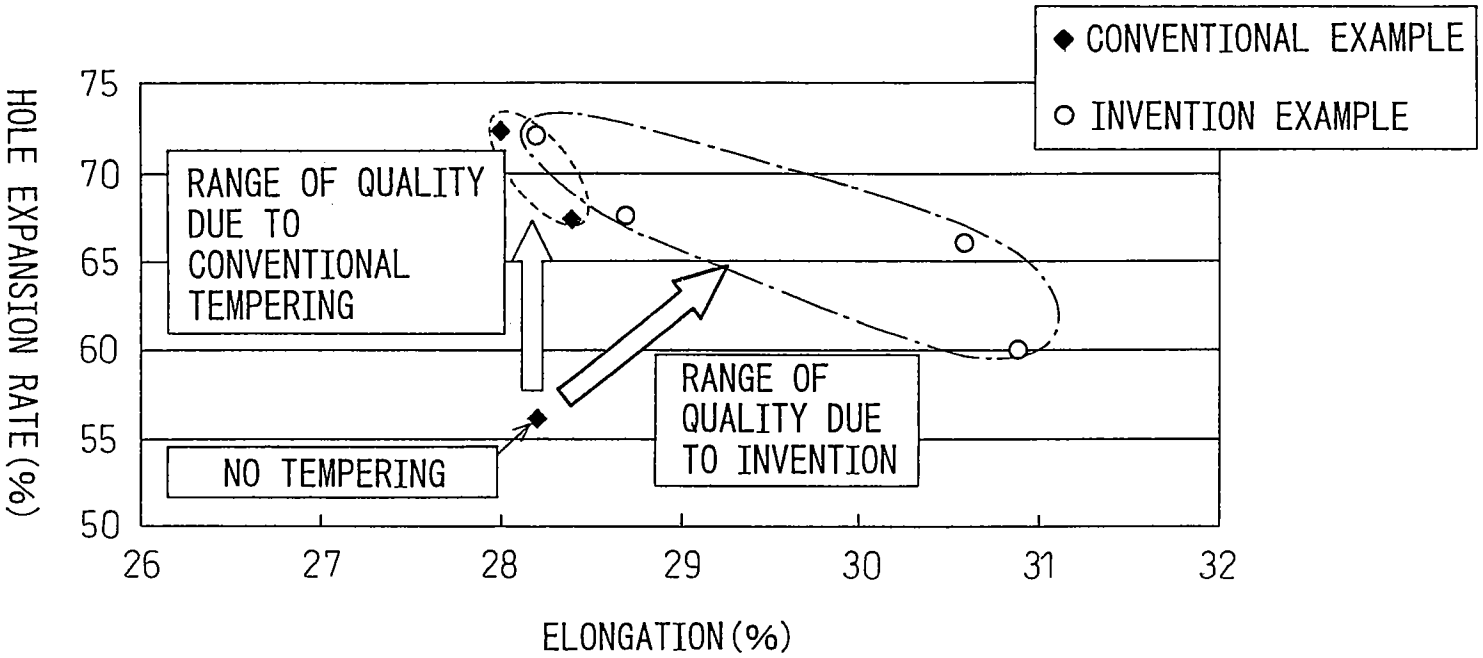
FIG. 5 is an exemplary graph of the relationship between the elongation and the hole expansion rate according to one exemplary embodiment of the present invention and the conventional method.

It is possible to arrange the quenching/tempering facility in the continuous annealing facility or hot dip zinc coating facility or their joint facility or continuously with the same being preferable, and the relationship between the tempering conditions and the hole expansion rate has been reviewed. It has been determined that the pre-tempering temperature, tempering temperature rise, post-tempering tensile strength, and hole expansion rate are in the exemplary relationships such as those shown in the graphs of FIGS. 2-4.

Therefore, based on these exemplary relationships, it has been ascertained that when the pre-tempering temperature, tempering temperature rise, post-tempering tensile strength, and hole expansion rate satisfy the exemplary relationship (A) and the exemplary relationship (B), the necessary tempered martensite can be secured and superior formability and hole expandability can be obtained.

$$0.028(\lambda-28)TS-11.5\lambda-40\leq\Delta T\leq 0.028(\lambda-28)TS-7.5\lambda-90 \quad (A)$$

$$[\{-2(\lambda-40)^2\}/10^5]\times(TS-580)^2-8\lambda+700\leq T\leq[\{-15(\lambda-45)\}/10^5]\times(TS-580)^2-\lambda+555 \quad (B)$$

where, λ: hole expansion rate (%)

TS: post-tempering tensile strength (MPa)

T: pre-tempering temperature T (° C.)

ΔT: tempering temperature rise (° C.)

If falling in the ranges of the above-described exemplary relationships (A) and (B) and/or if controlling them in the ranges in accordance with need or preference, it is possible to obtain high strength steel sheet or hot dip zinc coated high strength steel sheet having a balance of the tensile strength and hole expansion rate in accordance with the user demands or preferences.

Further, the above-described exemplary hole expansion rate λ is the rate when punching a 150 mm square test piece by a conical punch having a punching hole diameter of 10 mm, a clearance of 12%, and a peak angle of 60° and expanding the hole in a direction so that its burrs can become external portion(s) or side(s) by a forming speed of 0.5 mm/sec.

The amount of the tempered martensite of the high strength steel sheet obtained by the exemplary embodiments of the present invention can be, in terms of the area ratio, 0.5 to 60% in range. The tempered martensite may be evaluated by the exemplary method of observation under an optical microscope, observation of the martensite by LePera etching, quantization by LePera etching, polishing of the sample (alumina finish), dipping in a corrosive solution (mixed solution of pure water, sodium pyrosulfite, ethyl alcohol, and picric acid) for 10 seconds, then again polishing, rinsing, then drying the sample by cold air. After drying, the structure of the sample can be examined at, e.g., 1000× for a 100 μm×100 μm area by a Luzex apparatus and measured for area to determine the area of the tempered martensite. Further, the tensile strength and elongation can be evaluated by, e.g., conducting a tensile test in a direction perpendicular to the rolling direction of a JIS No. 5 tensile test piece.

Regarding the specifications of this exemplary quenching facility, since a certain extent of rapid cooling down to the martensite transformation point or less may be preferred, atomized water cooling, mist cooling, water spray cooling, or deep water cooling can be preferable, and even gas cooling may be used if giving an equal or better cooling rate as with atomized water cooling, mist cooling, water spray cooling, or deep water cooling.

Further, regarding the specifications of this tempering facility, to obtain an exemplary greater compactness of the facility or a reliable tempering effect in a short time, the heating system is preferably induction heating, but tempering by a gas burner, radiant tube oven, or electric heater oven may also be used if giving the same extent of greater compactness and reliable tempering effect in a relatively short time as with the induction heating. The exemplary cooling system of this exemplary re-cooling facility is not limited, and if considering the unnecessary oxidation and discoloration of zinc plating, gas cooling can be preferable.

The continuous annealing facility or hot dip zinc coating facility or joint facility of the same for installation of the quenching/tempering facility may also include a pre-plating facility for improving the plating adhesion. Further, for adding surface lubrication, corrosion resistance, and chemical conversion treatment, various post-treatment facilities may also be provided at the exit sides of the continuous annealing facility or hot dip zinc coating facility or joint facility of the same.

Further, the exemplary use of the exemplary embodiment of the facility according to the present invention can be advantageous for the elongation and hole expandability of high strength steel sheet, as described herein.

TABLE 1

| Ingredients | wt % |
|---|---|
| C | 0.093 |
| Si | 0.055 |
| Mn | 1.840 |
| P | 0.007 |
| S | 0.006 |
| Al | 0.500 |
| N | 0.007 |
| Ti | |
| Nb | 0.010 |
| Mo | 0.280 |
| B | |

For example, the exemplary steel having the composition of ingredients of Table 1 can be produced by a vacuum melting furnace, cooled to solidify, then reheated up to 1200 to 1240° C. and finish rolled at 880 to 920° C. (sheet thickness of 2.3 mm), cooled, then held at 600° C. for 1 hour so as to reproduce the coiling heat treatment of hot rolling. Such obtained hot rolled steel sheet may be descaled by polishing, 7 cold rolled (1.2 mm), then annealed using a continuous annealing simulator at 750 to 880° C.×75 seconds, hot dip zinc coated at 490° C., then alloyed at 510° C. Thereafter, such steel sheet can be treated under the conditions of Table 2 to confirm the effects of the exemplary embodiments of the facilities according to the present invention.

Experiments [1]-[3] of Table 2 below are comparative examples, wherein experiment [1] shows the case of quenching as is with no tempering, experiments [2] and [3] show the case of passage through a conventional continuous hot dip zinc coating facility and cooling (quenching) to ordinary temperature, then tempering by a separate line, and experiments [4]-[7] show the case of treatment by the exemplary embodiments of the facility according to the present invention.

TABLE 2

| | First heating and holding | | | | Temper | | | Hole | Tempered | |
|---|---|---|---|---|---|---|---|---|---|---|
| Exper. no. | Quench. temp. (° C.) | Temp. (° C.) | Holding time (min) | Cooling temp. (° C.) | rolling rate (%) | TS (MPa) | Elongation (%) | expansion rate λ (%) | martensite area ratio (%) | |
| [1] | Ord. temp. | — | — | — | 1 | 715 | 28.2 | 56 | ≤0.1 | Comp. ex. |
| [2] | Ord. temp. | 330 | 3 | Ord. temp. | | 676 | 28.4 | 67 | 21.1 | Comp. ex. |
| [3] | Ord. temp. | 380 | 3 | Ord. temp. | | 664 | 28.0 | 72 | 23.6 | Comp. ex. |
| [4] | 300 | 330 | 3 | Ord. temp. | | 648 | 30.9 | 60 | 18.7 | Inv. ex. |
| [5] | 120 | 330 | 3 | Ord. temp. | | 668 | 28.7 | 68 | 20.4 | Inv. ex. |
| [6] | 300 | 380 | 3 | Ord. temp. | | 639 | 30.6 | 66 | 19.6 | Inv. ex. |
| [7] | 120 | 380 | 3 | Ord. temp. | | 666 | 28.2 | 72 | 23.1 | Inv. ex. |

As described herein, the improvement in the material quality can be due to tempering by the exemplary embodiments of the facility according to the present invention by providing an improvement of the hole expandability, in addition, the improvement can also be provided by the ability to control the quenching/ tempering temperature conditions to any conditions gives an effect of improvement of the material quality including an improvement of the elongation.

EXEMPLARY INDUSTRIAL APPLICABILITY

According to the exemplary embodiments of the present invention, it is possible to provide a facility able to efficiently produce, both cost-wise and time-wise, high strength steel sheet or hot dip zinc coated high strength steel sheet excellent in elongation and hole expandability used for auto parts etc. and is extremely high in value industrially.

The foregoing merely illustrates the exemplary principles of the present invention. Various modifications and alterations to the described embodiments will be apparent to those skilled in the art in view of the teachings herein. It will thus be appreciated that those skilled in the art will be able to devise numerous modification to the exemplary embodiments of the present invention which, although not explicitly shown or described herein, embody the principles of the invention and are thus within the spirit and scope of the invention. All publications, applications and patents cited above are incorporated herein by reference in their entireties.

The invention claimed is:

1. A production arrangement for providing a steel sheet which is at least one of a steel sheet or a hot dip zinc coated steel sheet having a particular elongation and a hole expandability, the arrangement comprising:

a particular arrangement which is a combination of a continuous annealing facility and a continuous hot dip zinc coating facility, having a pass line bypassing the hot dip zinc coating facility, a quenching facility configured to cool the hot zinc coated steel sheet to a temperature region of about a martensite transformation point or less to generate a quenched steel sheet;

a tempering facility comprising a heating system having an induction heating portion, configured to temper the quenched steel sheet and maintain a temperature of the steel sheet; and a recooling facility configured to cool the steel sheet to the temperature of the steel sheet at about 100° C. or less.

2. The production arrangement according to claim 1, wherein the tempering facility is configured to generate a tempering temperature rise ΔT between the quenching facility and the tempering facility which is capable of falling in a range of a first relationship (A) obtained from a post-tempering tensile strength TS and a hole expansion rate λ, wherein a pre-tempering temperature T (° C.) falls in a range of a second relationship (B) obtained from the post-tempering tensile strength TS and the hole expansion rate λ, wherein the first relationship is defined as $$0.028(\lambda-28)TS-11.5\lambda-40 \leq \Delta T \leq 0.028(\lambda-28)TS-7.5\lambda-90 \quad (A)$$

wherein the second relationship is defined as:

$$[\{-2(\lambda-40)\hat{}2\}/10\hat{}5]\times(TS-580)\hat{}2-8\lambda+700 \leq T \leq /\{-15(\lambda-45)\}/10\hat{}5]\times(TS-580)\hat{}2-\lambda+555 \quad (B)$$

where, λ is the hole expansion rate (%)

TS is the post-tempering tensile strength (MPa)

T is the pre-tempering temperature T(° C.)

ΔT is the tempering temperature rise (° C.).

3. The production arrangement according to claim 1, wherein the quenching facility comprises a cooling system having at least one of an atomized water cooling portion, a mist cooling portion, a water spray cooling portion, or a deep water cooling portion.

4. The production arrangement according to claim 1, further comprising an alloying facility.

* * * * *